US007641590B2

(12) United States Patent
Chan

(10) Patent No.: US 7,641,590 B2
(45) Date of Patent: Jan. 5, 2010

(54) SWIMMING LAP COUNTER

(75) Inventor: Raymond Chan, Hong Kong (CN)

(73) Assignee: IDT Technology Limited, Hong Kong SAR (CN)

( * ) Notice: Subject to any disclaimer, the term of this patent is extended or adjusted under 35 U.S.C. 154(b) by 529 days.

(21) Appl. No.: 11/455,762

(22) Filed: Jun. 20, 2006

(65) Prior Publication Data

US 2007/0293374 A1 Dec. 20, 2007

(51) Int. Cl.
*A63B 71/00* (2006.01)

(52) U.S. Cl. ..... 482/3; 482/55; 434/247

(58) Field of Classification Search ..... 482/1–9, 482/51, 55, 56, 900–902; 377/1, 5, 6, 15, 377/19, 20, 24.2; 434/247, 254
See application file for complete search history.

(56) References Cited

U.S. PATENT DOCUMENTS 3,903,610 A * 9/1975 Heaviside et al. ..... 33/361
4,103,279 A * 7/1978 Dildy et al. ..... 367/87
4,530,105 A 7/1985 Rabinowitz
4,932,045 A 6/1990 Kasoff et al.
5,844,960 A * 12/1998 Sham et al. ..... 377/24.2
5,908,466 A 6/1999 Veugen et al.
2002/0151810 A1 10/2002 Wong et al.
2006/0098772 A1 5/2006 Reho et al.

FOREIGN PATENT DOCUMENTS

WO WO 00/67858 A 11/2000

* cited by examiner

*Primary Examiner*—Glenn Richman
(74) *Attorney, Agent, or Firm*—Leydig, Voit & Mayer, Ltd.

(57) ABSTRACT

A lap counter for use by a swimmer, has a case for attaching to the swimmer, and a compass sensor housed in the case for providing an output signal which changes between opposite directions along which the swimmer swims back and forth. An operating circuit includes a processor programmed to distinguish the change in the output signal of the compass sensor between the opposite directions to identify a reversal in direction of swimming by the swimmer and to count laps, each lap being based on two successive reversals in direction. The processor may also be programmed to distinguish the change in the compass sensor output signal to detect a rise above an upper threshold and a subsequent fall below a lower threshold, or vice versa, to identify, a wave in the output signal that represents a swimming stroke of the swimmer and to count the strokes.

20 Claims, 8 Drawing Sheets

40

SWIMMING LAP COUNTER

The present invention relates to a lap counter for swimming exercise or the like.

Particularly but not exclusively, the invention relates generally to a waterproof wristwatch for counting and indicating the number of laps, speed and distance traversed by a swimmer in a pool, and calorie consumption for a swimming exercise.

BACKGROUND OF INVENTION

The most important concern for a swimming enthusiast or athlete swimmer is the distance that he/she swims in a training session. Since in the majority of cases people swim in a swimming pool of a standard length such as 25 or 50 meters, the swimming distance can be measured by reference to the lap count. Mentally counting the laps can be both inaccurate and mentally taxing, and is certainly a red herring preventing the swimmer from fully concentrating on the performance.

U.S. Pat. No. 4,932,045 discloses a waterproof digital lap counter having the lap counter attached to a hand or foot, which is triggered by abutment of the lap counter against the side of the swimming pool during the swimming stroke or flip turn of the swimmer. There are several similar swimming lap counter products on the market, which invariably include a switch or press button for the user to press once a lap is finished.

A major disadvantage or problem associated with such lap counters lies in the need to manually operate a switch at the end of each lap. This is an extra action required from the swimmer that interrupts the swimmer's strokes and/or prevents him from performing a smooth turn.

The invention seeks to eliminate or to at least alleviate such a problem by providing a new or otherwise improved swimming lap counter that is more convenient to use.

SUMMARY OF THE INVENTION

According to the invention, there is provided a lap counter for use by a swimmer, comprising a case, attachment means for attaching the case onto said swimmer, and a compass sensor housed in the case for providing an output signal which changes as between opposite directions along which said swimmer swims back and forth. There is also an operating circuit which includes a processor programmed to distinguish the change in the output signal of the compass sensor as between said opposite directions to thereby identify a reversal in direction of said swimmer and then to count the number of laps each based on two successive reversals in direction.

Preferably, the compass sensor comprises a two-axis magnetometer.

Preferably, the attachment means is elongate and is adapted to extend around part of said swimmer.

More preferably, the attachment means comprises a strap for attaching around a wrist of said swimmer.

It is preferred that the attachment means comprises a clip.

It is preferred that the lap counter includes a display on the case for displaying the number of laps.

In a preferred embodiment, the operating circuit includes a low-pass filter for filtering the output signal of the compass sensor.

More preferably, the low-pass filter is tuned to a frequency higher than 3 Hz.

Further more preferably, the low-pass filter is tuned to a frequency of 5 Hz.

It is preferred that the processor is programmed to implement the low-pass filter.

In a preferred embodiment, the operating circuit includes a rectifier for removing fluctuating portions of the output signal of the compass sensor.

More preferably, the processor is programmed to implement the rectifier.

In a preferred embodiment, the operating circuit includes a sliding window averaging circuit for smoothing the output signal of the compass sensor.

More preferably, the sliding window averaging circuit is operable with a window width of substantially three seconds.

More preferably, the processor is programmed to implement the sliding window averaging circuit.

In a preferred embodiment, the lap counter includes input means on the case for input of body weight of said swimmer, wherein the operating circuit is programmed to identify the change in the output signal of the compass sensor as between successive strokes of said swimmer for determining stroke frequency, and to calculate calorie consumption by said swimmer according to the number of laps, the stroke frequency, body weight of said swimmer and duration of swimming.

In a preferred embodiment, the processor is programmed to distinguish the change in the output signal of the compass sensor to detect a rise above a predetermined upper threshold and a subsequent fall below a predetermined lower threshold, or vice versa, to thereby identify a wave in the output signal representing a swimming stroke of said swimmer and count the strokes.

The invention also provides a stroke counter for use by a swimmer, comprising a case, attachment means for attaching the case onto said swimmer, and a compass sensor housed in the case for providing an output signal which changes as said swimmer swims. There is also an operating circuit which includes a processor programmed to distinguish the change in the output signal of the compass sensor to detect a rise above a predetermined upper threshold and a subsequent fall below a predetermined lower threshold, or vice versa, to thereby identify a wave in the output signal representing a swimming stroke of said swimmer and count the strokes.

Preferably, the processor includes means for determining the time between a presently detected wave in the output signal and a last identified wave and then comparing said time with a predetermined value for validating said detected wave.

More preferably, the predetermined value comprises a range within which said time should fall for said detected wave to be validated.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
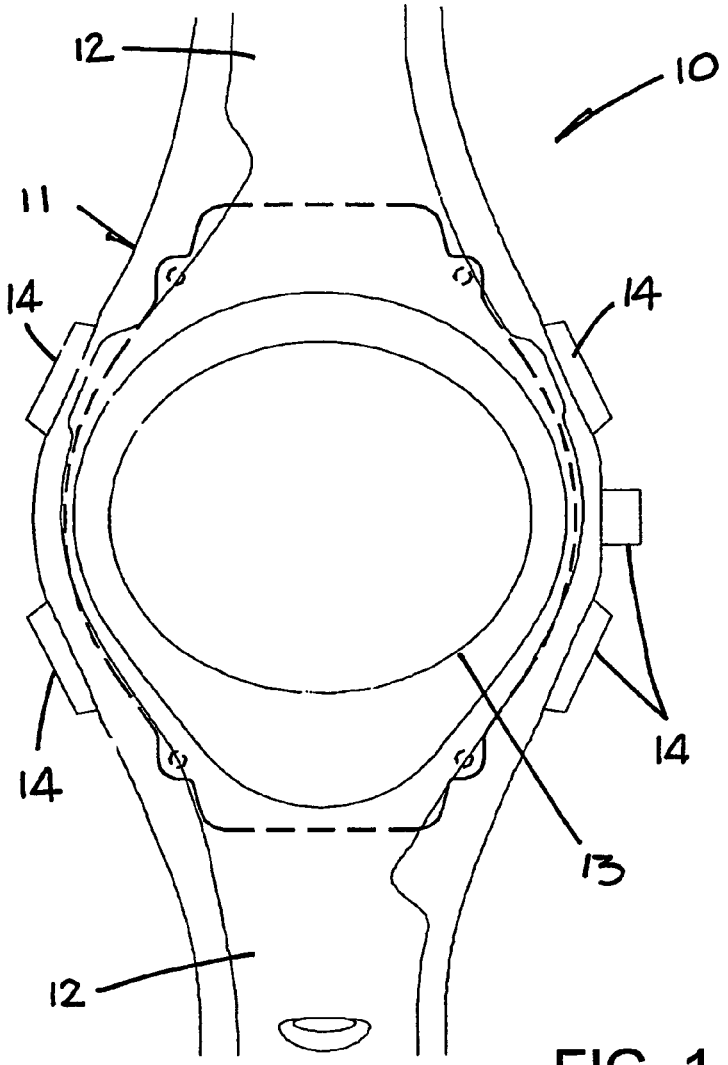
FIG. 1 is a front view of an embodiment of a lap counter in accordance with the invention for use by a swimmer, in the form of a wristwatch.
Figure 3:
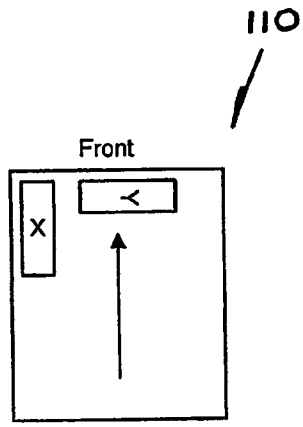
FIG. 3 is a schematic diagram of the compass sensor of FIG. 2.
Figure 2:
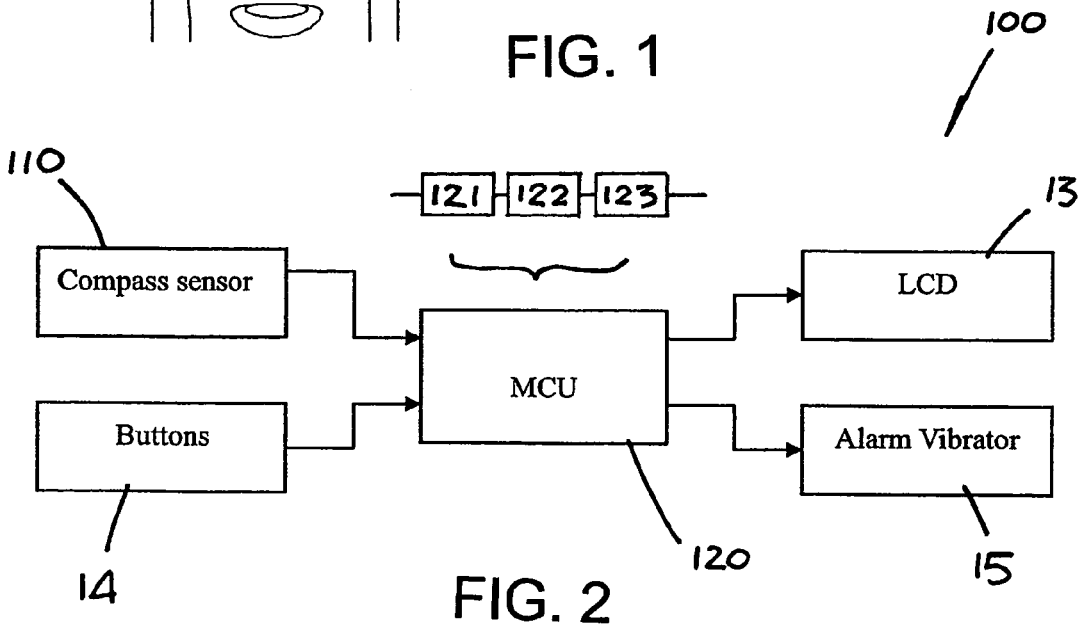
FIG. 2 is a functional block diagram of the lap counter of FIG. 1, including a compass sensor.

Referring initially to FIGS. 1 to 3 of the drawings, there is shown a lap counter 10 for use by a swimmer Q embodying the invention, which takes the form of a wristwatch having a case 11 and attachment means such as a watch strap 12 for attaching the case 11 around a wrist of the swimmer Q. The lap counter 10 includes an LCD panel/display 13 for displaying data (such as lap count and time, etc.) and a number of press keys/buttons (and a turning knob) 14 for operation control and data input such as the swimmer's body weight and the swimming style (if necessary).

Generally stated, the attachment means is elongate and is adapted to extend around part of the swimmer Q. Another example is a band or belt that attaches the overall lap counter 10 onto the swimmer's waist. In an alternative form, the attachment means may comprise a clip fixed on the case 11 for attaching the lap counter 10 onto the swimmer's outfit such as the swimming suit (on the waist) or the swimming cap (on the head).

The lap counter 10 operates under the control of an electronic operating circuit housed in the case 11, which is built based upon a solid-state MCU (microprocessor or main control unit) 120 programmed to perform various functions in different operating modes. For example, the MCU 120 incorporates a low-power CMOS monostable/astable multivibrator to implement a digital clock circuit which provides a digital square wave for time keeping and to drive other circuits, such as the LCD display 13 connected thereto for indicating time/date information in digital format that can be read directly.

An alarm vibrator 15, driven by a micro-motor for example, is connected to and operated by the MCU 120 to provide a vibrational alarm signal for indicating the occurrence of a predetermined condition. The alarm signal is made vibrational, rather than audio, to ensure that it will get noticed in the water.

In addition to the reaching of a preset time for conventional time alarm, there are several other predetermined conditions that can be monitored by the vibrational alarm function. Such conditions are mainly concerned with the amount of exercise the swimmer does or calorie he/she burns, and are measured according to the number of laps (i.e. lap alarm), the distance covered (i.e. distance alarm) or the swimming duration (i.e. duration alarm) as selected by the swimmer. Furthermore, the swimmer can also choose a target swimming speed and set the alarm to go off when the speed is attained (i.e. speed alarm).

Input data and user controls, such as mode change or data input selection, are entered by means of the buttons 14 that are connected to the MCU 120.

The lap counter 10 includes a compass sensor 110 housed in the case 11, whose output is connected to the MCU 120, for instantaneous detection of direction or heading: The compass sensor 110 typically comprises a two-axis magnetometer (FIG. 3) which is the minimum sensor configuration required to detect and calculate a magnetic compass heading and to provide a corresponding output signal that indicates the direction in which the magnetometer is headed or oriented. In this particular embodiment, the compass sensor 110 samples the compass heading at a sampling frequency of at least 32 Hz.

In the planned scenario, the swimmer Q swims back and forth along a swimming pool having a standard, or otherwise known, length that is typically 50 meters (long course) or 25 meters (short course). With the lap counter 10 being used on the swimmer Q (e.g. his/her wrist or head), the compass sensor 110 provides an output signal that changes instantaneously as the relevant part of the swimmer Q (i.e. his/her wrist or head) moves and, in particular on a larger scale, as the swimmer Q turns around at one end of the pool reversing from one direction to the opposite direction.

Figure 4:
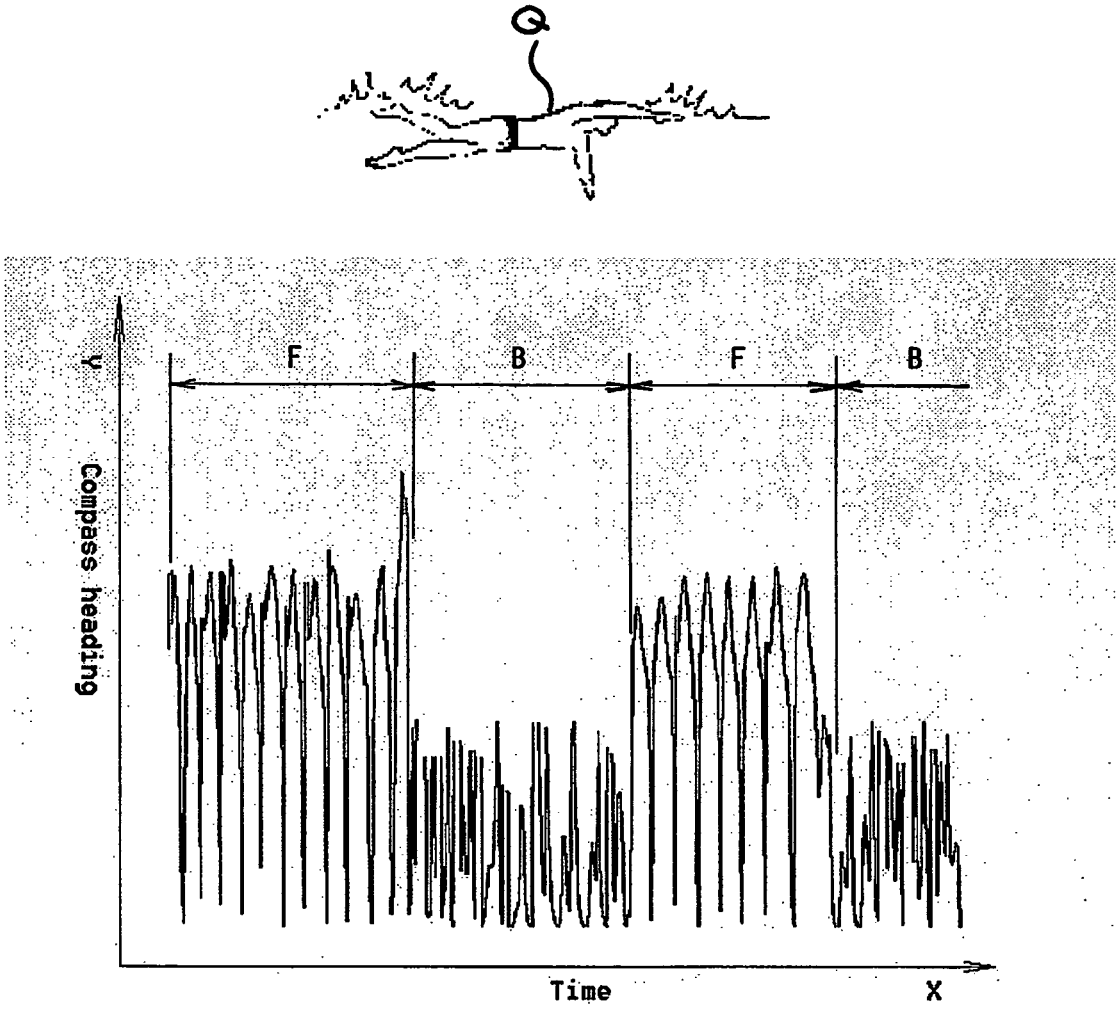
FIG. 4 is a schematic diagram showing a typical output waveform of the compass sensor of FIG. 3, when the lap counter is worn on the wrist of a freestyle swimmer.

FIG. 4 shows a typical waveform of the output signal of the compass sensor 110 when the lap counter 10 is worn on the wrist of a freestyle swimmer. The waveform comprises two distinct alternating regions F and B, in that each region F is of a relatively higher compass heading value when the swimmer swims, say, in the forward direction and each region B has a relatively lower compass heading value in the backward direction. The duration of these regions F and B is understandably not constant as it varies with the speed of the swimmer. Each of the regions F and B is made up of a series of some eight to eleven much narrower pulses/waves of much shorter durations, and each of these waves represents, one stroke of the arm wearing the lap counter 10.

Figure 5:
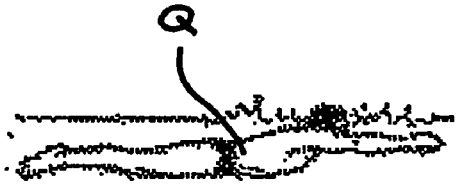
FIG. 5 is a schematic diagram showing a typical output waveform of the compass sensor of FIG. 3, when the lap counter is worn on the wrist of a breaststroke swimmer.
Figure 5:
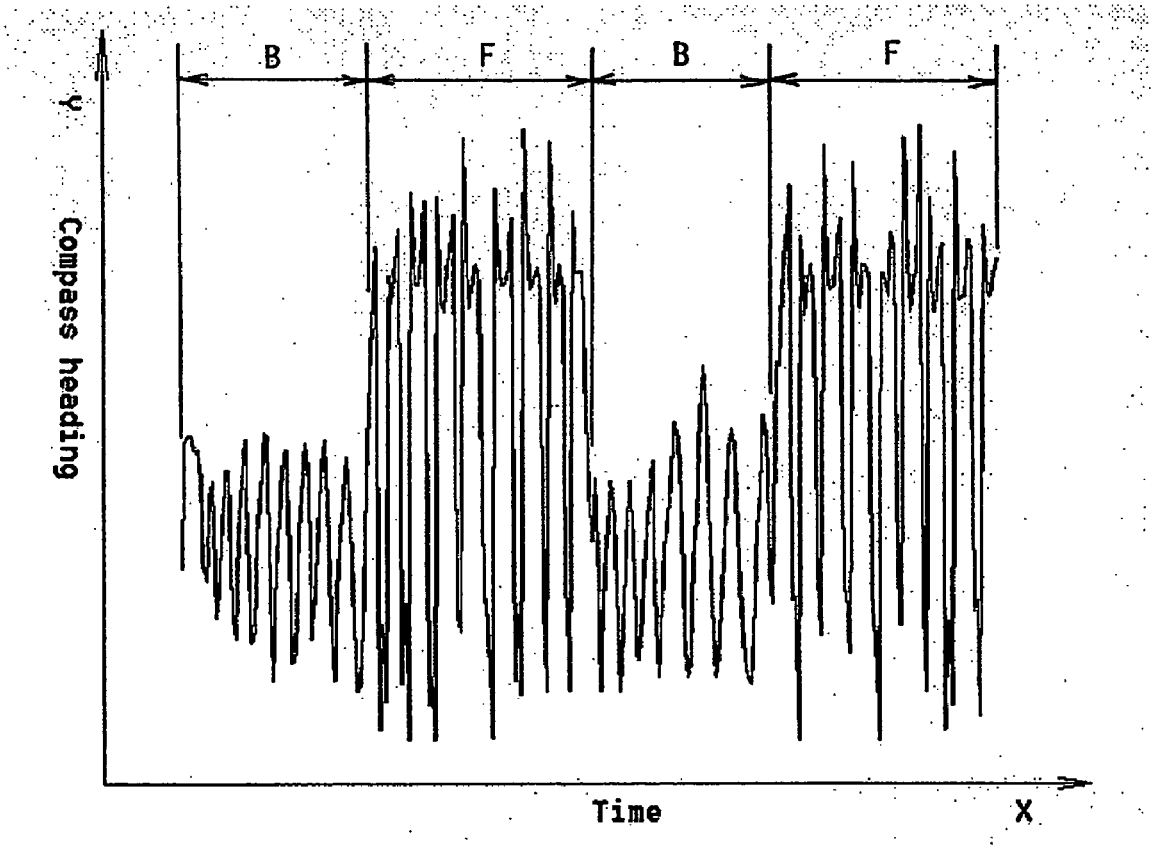

FIG. 5 shows a typical waveform of the output signal of the compass sensor 110 when the lap counter 10 is worn on the wrist of a breaststroke swimmer. The waveform is likewise formed by two alternating regions F and B in general, which are distinguishable from each other as described above and each of which similarly comprises a series of much shorter waves.

Figure 6:
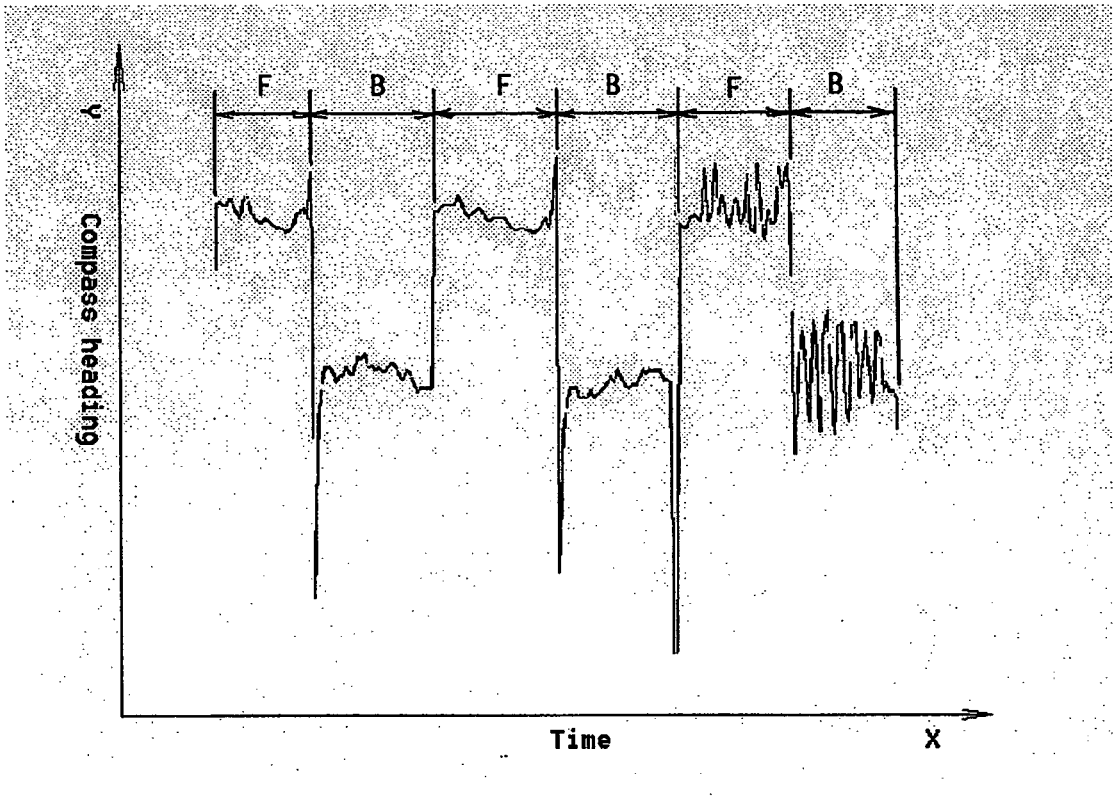
FIG. 6 is a schematic diagram showing a typical output waveform of the compass sensor of FIG. 3, when the lap counter is attached on the head or trunk of a swimmer.

FIG. 6 depicts a typical waveform of the output signal of the compass sensor 110 when the lap counter 10 is worn on the head or waist/trunk of a swimmer. This waveform is also generally formed by two distinct alternating regions F and B, but the series of waves occupying each of these regions F and B is considerably smoother (i.e. much less rippling) because the head or waist/trunk moves significantly less, in terms of extent of movement in particular, than the wrists mentioned earlier.

As part of the operating circuit 100, the MCU 120 is programmed to implement a digital low-pass filter 121, a digital rectifier 122 and a digital sliding window averaging circuit 123 for processing the output signal of the compass sensor 110. Such auxiliary modules 121, 122 and 123 may of course be built by using the conventional electronic components such as capacitors, inductors, resistors and/or op-amps, though considering size, power consumption and flexibility the software approach has been adopted in the described embodiment.

Figure 7:
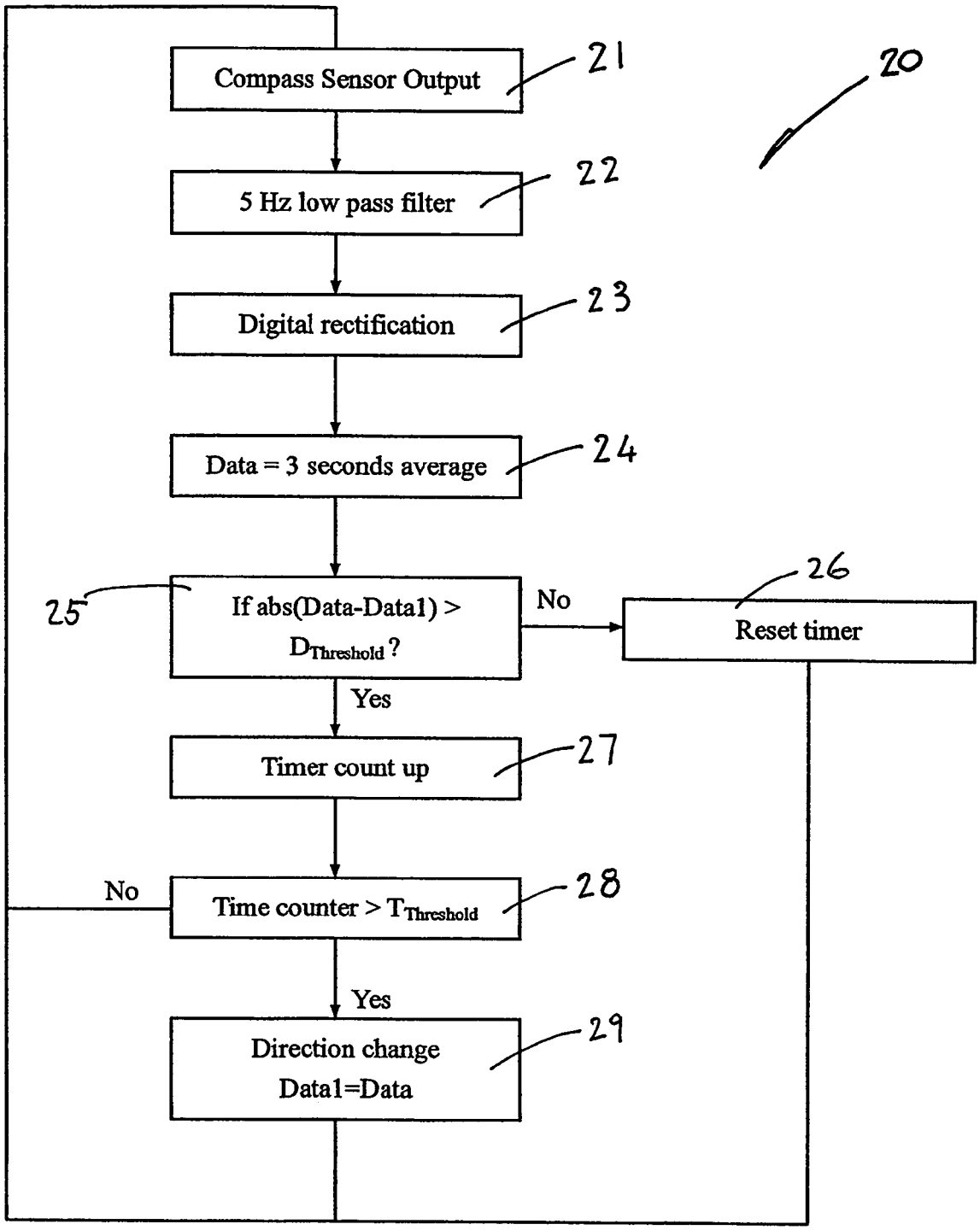
FIG. 7 is a flow chart illustrating the operation of the lap counter of FIG. 1.

As a primary function, the MCU 120 is programmed to analyze and distinguish the change in the waveform of the output signal of the compass sensor 110 as between opposite directions to thereby identify a reversal in direction of the swimmer Q at either pool end and then to count the number of laps each based on two consecutive reversals in direction. The algorithm 20 based on which the MCU 120 performs this lap count function is now described with reference to FIG. 7.

The compass sensor 110 produces a varying output signal as it is being moved by the swimmer Q (Block 21). The normal swimming stroke frequency is about 40 to 150 strokes per minute, and this translates into a frequency of about 0.7 to 2.5 Hz for the compass sensor's motion and hence its output signal. The useful frequency range of the output signal is accordingly determined as 0 to 5 Hz, with an upper limit at twice the highest frequency that may be encountered during operation to provide an adequate leeway.

Figure 4A:
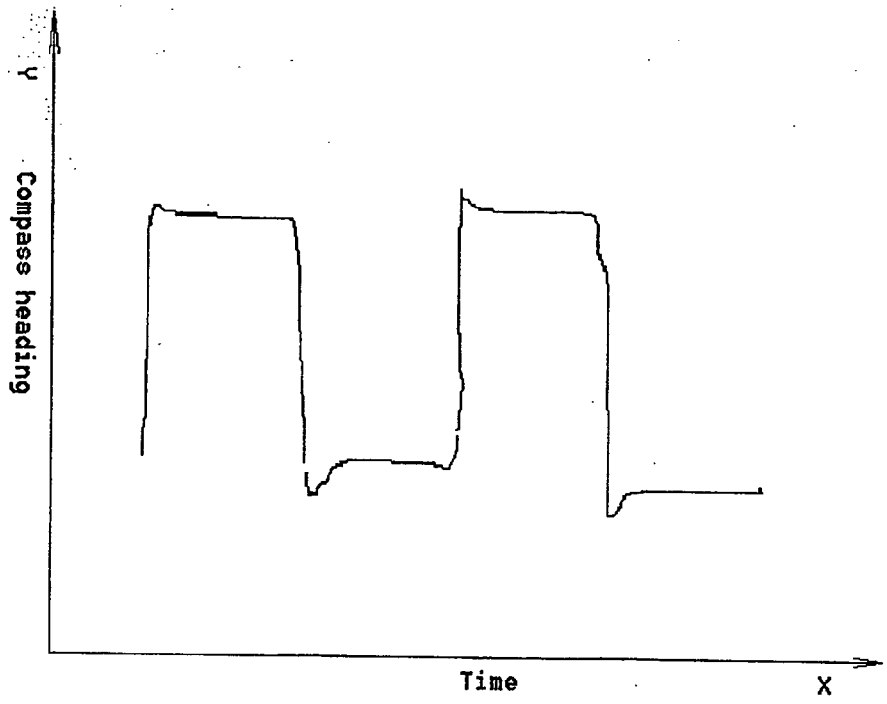

The output signal is first fed through the low-pass filter 121 (Block 22) for filtering thereby, which is tuned to the upper limit 5 Hz of the useful frequency range such that all unwanted frequency components that are over 5 Hz are blocked off. In general, the filter 121 may be tuned to a frequency higher than 3 Hz, just above 2.5 Hz. The filtered output signal is then fed through the digital rectifier 122 (Block 23) for removing the signal's fluctuating components or ripples. The resulting waveform, which stems from that of FIG. 4, is shown in FIG. 4A.

Figure 4B:
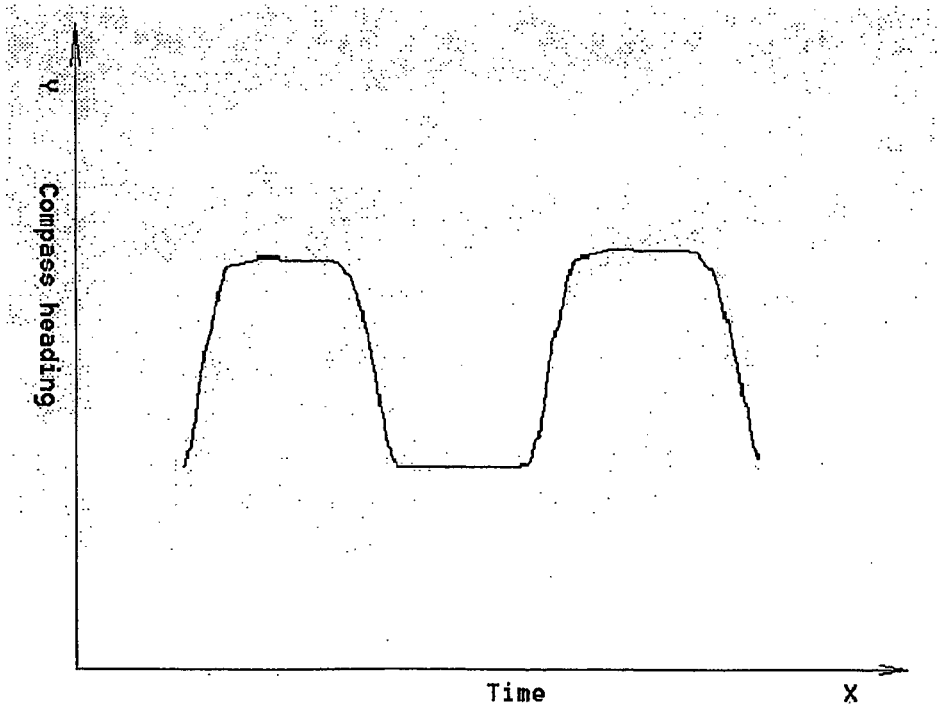

The rectified output signal of the compass sensor 110 is subsequently processed by the sliding window averaging circuit 123 (Block 24) for further smoothing the signal such that it assumes a neat waveform as shown in FIG. 4B. The averaging circuit 123 is designed to operate with a sliding window having a width of about three seconds, which is determined to be optimum based on the normal swimming stroke frequency.

The lap counting process of the MCU 120 proceeds to detect a change in the processed output signal of the compass sensor 110, by analyzing its waveform, that correctly represents an action of turning around of the swimmer Q at either end of the swimming pool. The change in the output signal is considered indicative of a genuine turning around if the change in magnitude is sufficient (i.e. greater than "$D_{Threshold}$") and such a change sustains for a sufficiently long period of time (i.e. longer than "$T_{Threshold}$").

The value of "$D_{Threshold}$" is determined for optimum waveform analysis, and is primarily based upon the sensitivity and output range of the compass sensor (magnetometer) 110 employed. The value of "$T_{Threshold}$" should be considerably shorter than the time it would take for the swimmer to finish one pool length i.e. between successive turnings, but on the other hand the value should be sufficiently long to distinguish a genuine turn from a false turn as may be caused, for example, by the swimmer who stops and turns his/her arm or head/body (i.e. the compass sensor 110) around unexpectedly for a moment before reaching the pool end. "$T_{Threshold}$" is chosen to be several seconds, over three seconds.

The change in magnitude is monitored by a data comparison step (Block 25) which checks whether or not the absolute difference between the prevailing magnitude "Data" and the magnitude "Data1" last recorded exceeds the threshold "$D_{Threshold}$". In the negative i.e. the difference in magnitude is not sufficient, a certain timer in the MCU 120 is reset (Block 26) and the process returns to and restarts from the beginning (Block 21).

In the affirmative i.e. the difference in magnitude is sufficient, the timer starts to count up (Block 27) and continues for so long as the difference in magnitude sustains (i.e. greater than "$D_{Threshold}$") until the timer's count exceeds "$T_{Threshold}$" (Block 28), at which time a turning around by the swimmer Q is registered and the prevailing magnitude "Data" is entered as the magnitude "Data1" last recorded (Block 29), and the process then restarts from Block 21. If the difference in magnitude does not sustain for long enough such that the timer stops prematurely (Block 28) i.e. upon detecting a false turning around, the process will restart from Block 21.

The MCU 120 includes a dedicated counter which keeps track of the swimmer's turnings around detected according to the algorithm as described above, and it counts two such turnings around as one lap to produce a lap count automatically. For a count-up function, the lap count (from zero) may be read from the display 13. For a count-down function, the lap count reduces from a user-preset target and when it reaches zero the alarm vibrator 15 goes off to alert the swimmer.

The MCU 120 has inherent calculation facilities. Based on the detected turnings around of the swimmer, the individual or average lap time can readily be determined by reference to the time kept by the aforesaid clock circuit. The swimming time or duration is simply measured. The total swimming distance can also be calculated by multiplying the pool length by the lap count, and the average speed by dividing the total distance by the swimming time. Using the shortest lap time i.e. the time of the quickest lap, the maximum speed can also be calculated by dividing twice the pool length by the lap time.

The MCU 120 is also programmed, by analyzing the waveform of FIG. 4 or 5 with the lap counter 10 worn on the swimmer's wrist in particular, to identify the narrower waves within each of the regions F and B, each successive stroke can also be recognized and counted. Although the algorithm adopted is somewhat different, the underlying principle is the same i.e. by analyzing the change in magnitude of the output signal of the compass sensor 110 (compass heading data), though on a considerably smaller time scale. The lap counter 10 is therefore able to count laps as well as strokes, and equivalent or similar data for strokes as for laps can readily be determined or calculated e.g. the total number of strokes and stroke frequency.

Figure 8:
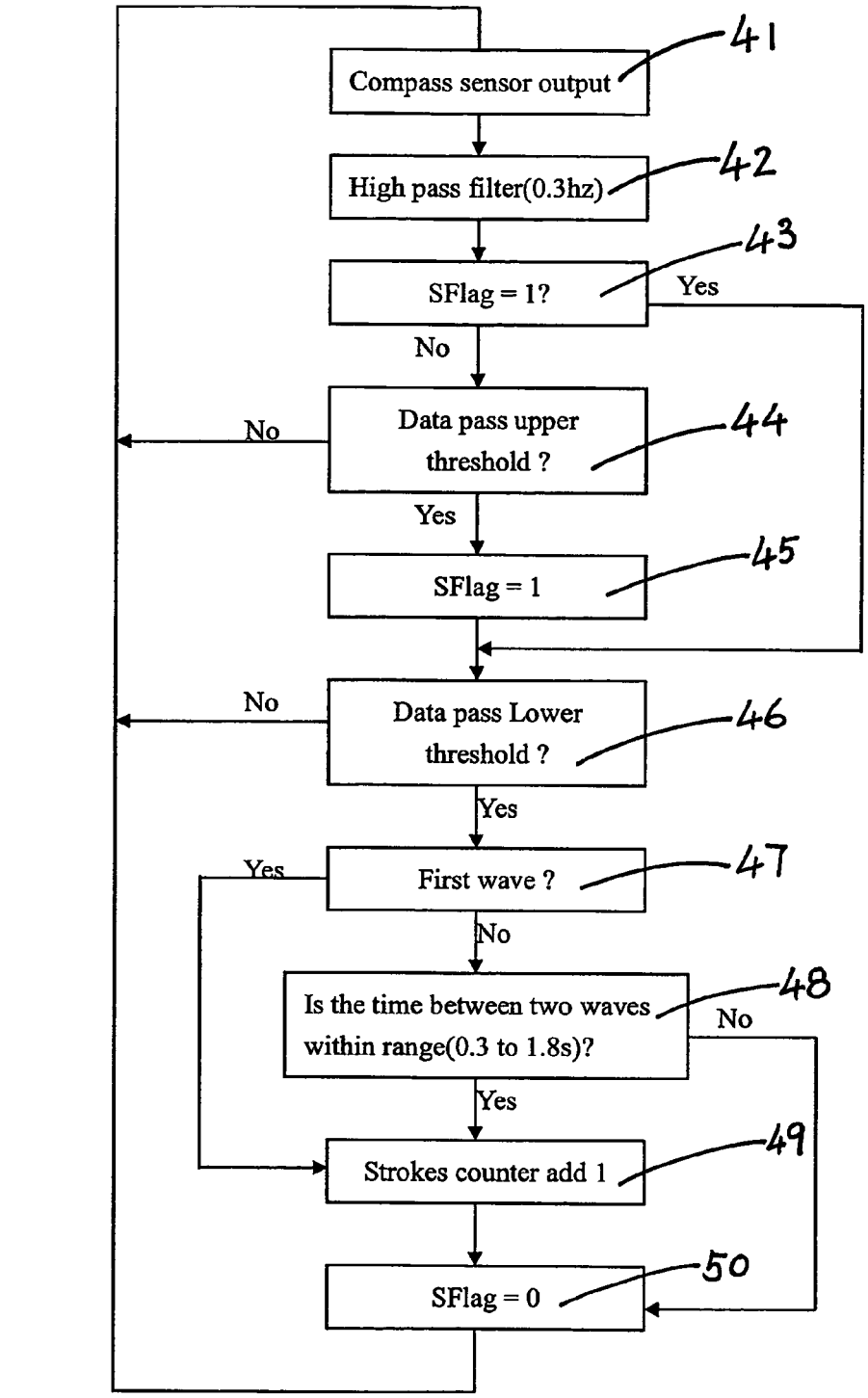
FIG. 8 is a flow chart that illustrates a stroke counting operation of the lap counter of FIG. 1.

A stroke counting algorithm 40 is now described as an example with reference to FIG. 8. The occurrence of a swimming stroke is identified by detecting the relevant narrower wave, in the compass heading signal, which rises above a certain upper threshold and then falls below a certain lower threshold, and on the condition that the presently detected stroke wave occurs later than the last identified wave within a time interval in the range of 0.3 to 1.8 seconds.

The values of the upper and lower thresholds are device-dependent (i.e. depending upon the particular compass sensor 110 in use) and are predetermined by experiments based on actual swimming strokes. The time range of 0.3 to 1.8 seconds is derived from the aforesaid normal stroke frequency of 40 to 150 strokes per minute, with some buffer.

The output signal of the compass sensor 110 (Block 41) is first fed through a high-pass filter (Block 42) for suppressing the DC component so as to extract only the stroke information. The high-pass filter is tuned to 0.3 Hz, a frequency that is optimally below the aforesaid compass output frequency range of 0.7 to 2.5 Hz.

There is a register "SFlag" (Stroke Flag) in the MCU 120 for keeping track of the rise (i.e. rising edge) and fall (i.e. falling edge) of the stroke waves as detected by the compass sensor 110. The content of the SFlag register being "0" or "1" stand for the rise (start) or fall (finish) of a stroke wave respectively. If SFlag=1 (Block 43), the MCU operation jumps to detecting finish % of a stroke wave. If SFlag?1 (Block 43), a stroke wave starts and the compass signal is checked to see whether it rises above the upper threshold (Block 44). In the affirmative, the content of SFlag is made "1" (Block 45) to prepare for subsequent finishing of the wave and the compass signal is checked to see whether it then falls below the lower threshold (Block 46). In the affirmative, a stroke wave is detected.

If the result of the checking with either the upper or lower threshold is negative i.e. no rise or fall of a stroke wave is considered detected, the operation returns to the beginning (Block 41) and restarts.

Upon detection of a first stroke wave (Block 47), a stroke counter (e.g. in the MCU 120) increases the stroke count by one (Block 49) and the SFlag is finally reset to "0" (Block 50) for detecting the next wave (by its rise). If the detected stroke wave is not the first wave (Block 47), the NCU 120 checks whether the time between the presently detected wave and the last identified wave is in the qualifying range from 0.3 to 1.8 seconds. In the affirmative, the stroke is validated and the stroke/count is increased by one (Block 49) and the SFlag is finally reset to "0" (Block 50) for detecting the next wave. In the case that the present wave occurs too early or too late, it is considered false (i.e. not validated) and the SFlag is reset to "0" (Block 50) without updating the stroke count.

Each of the stroke waves in the output signal of the compass sensor 110 is identified to start with a rising edge and to finish with a falling edge. On the contrary, it is understood that a stroke wave can equally be recognized as a negative wave that starts with a falling edge and ends with a rising edge.

In this particular embodiment, the lap counter and the stroke counter are independent functions, in that they are not synchronized, but this is possible for example to count strokes for a specific lap or each lap.

The usual swimming styles are freestyle, breaststroke, backstroke and butterfly. A comparison between the output waveform of a wrist-mounted compass sensor 110 of FIG. 4 for freestyle) and that of FIG. 5 for breaststroke indicates that there are discernible differences between different swimming styles, such as the shape of the individual stroke waves and/or the general profile across the stroke waves. The MCU 120 is also programmed, by analyzing the waveform, to identify the swimming style, especially when the compass sensor 110 is worn on the wrist.

Figure 9:
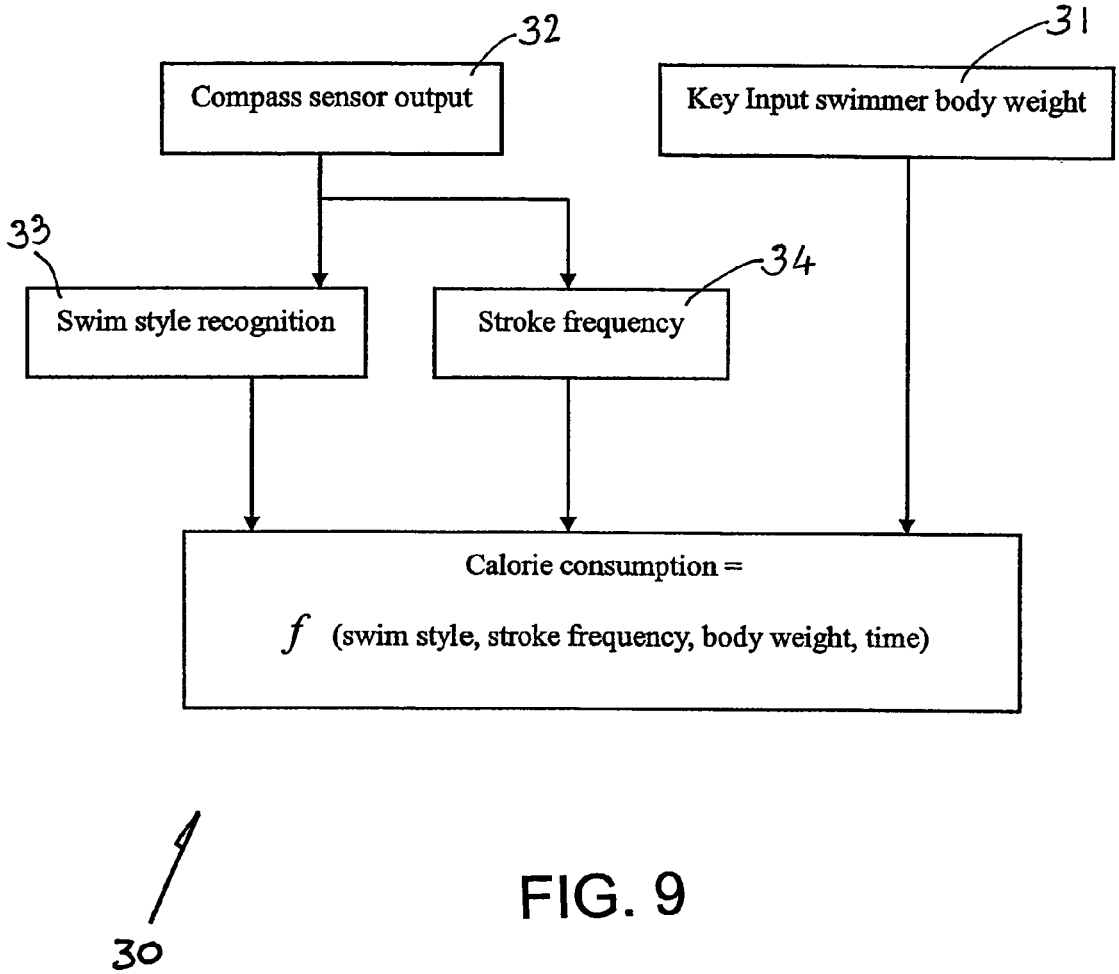
FIG. 9 is a flow chart that illustrates how the lap counter of FIG. 1 calculates calorie consumption by the swimmer.

FIG. 9 illustrates how the MCU 120 calculates calorie consumption (including fat burning percentage) by the swimmer Q according to an algorithm 30 which is based upon the key input swimmer's body weight (Block 31), the swimming style recognized (Block 33), and the stroke frequency (Block 34) and swimming time or duration as derived from the output signal of the compass sensor 110 (Block 32). The calorie calculation equation is as follows:

$$\text{Calories burnt} = K * \text{body weight} * \text{time}$$

Coefficient K is a predetermined constant that varies with different swimming styles. More calories are burnt for butterfly style than for freestyle and breaststroke style. A higher stroke frequency means more calories is to be consumed.

In a nutshell, the lap counter 10 is designed to perform the following functions:

1. Lap count, including both count down and/or count up
2. Lap time, total number of strokes and average speed of each lap
3. Speed (average and maximum speed) and total distance
4. Presettable Lap/speed/distance alarms with vibration alarm
5. Calorie consumption and fat burning percentage Counting of swimming laps is achieved through analysis of the output waveform of a compass sensor (magnetometer), including filtering, amplitude averaging, phase detection and pattern recognition dependent upon the characteristic of the compass heading waveforms for different swimmers and different swimming styles.

The subject invention solves the problems of swimming lap counting by providing a convenient and automatic device for counting laps, which does not require any action from the swimmer and therefore will not disrupt his/her swimming motion or strokes. This is accomplished by using a compass sensor (magnetometer) and analyzing its output waveform according to a predetermined algorithm. The lap count and calculated speed/distance will be displayed on an LCD panel. All the components including the compass sensor and processing circuits, MCU and LCD panel are packed within a waterproof case which may take the form of a wristwatch, or in a different embodiment, clip for attaching to a swimming cap or swimsuit.

Health conscious people often want to monitor their calorie consumption during swimming exercise, and the subject lap counter offers a calorie calculating function to meet that need.

The invention has been given by way of example only, and various other modifications of and/or alterations to the described embodiment may be made by persons skilled in the art without departing from the scope of the invention as specified in the appended claims.

What is claimed is:

1. A lap counter for use by a swimmer, comprising:
a case;
attachment means for attaching the case to a swimmer;
a compass sensor housed in the case providing an output signal which changes between opposite directions along which the swimmer swims back and forth; and
an operating circuit including
a processor programmed to distinguish changes in the output signal of the compass sensor between the opposite directions to identify a reversal in direction of swimming by the swimmer and to count laps, each lap being based on two successive reversals in direction, and
a sliding window averaging circuit for smoothing the output signal of the compass sensor.

2. The lap counter as claimed in claim 1, wherein the compass sensor comprises a two-axis magnetometer.

3. The lap counter as claimed in claim 1, wherein the attachment means is elongate for extending around a part of the swimmer.

4. The lap counter as claimed in claim 3, wherein the attachment means comprises a strap for attaching around a wrist of the swimmer.

5. The lap counter as claimed in claim 1, wherein the attachment means comprises a clip.

6. The lap counter as claimed in claim 1, including a display on the case for displaying number of laps.

7. The lap counter as claimed in claim 1, wherein the operating circuit includes a low-pass filter for filtering the output signal of the compass sensor.

8. The lap counter as claimed in claim 7, wherein the low-pass filter is tuned to a frequency higher than 3 Hz.

9. The lap counter as claimed in claim 8, wherein the low-pass filter is tuned to a frequency of 5 Hz.

10. The lap counter as claimed in claim 7, wherein the processor is programmed to implement the low-pass filter.

11. The lap counter as claimed in claim 1, wherein the operating circuit includes a rectifier for removing fluctuating portions of the output signal of the compass sensor.

12. The lap counter as claimed in claim 11, wherein the processor is programmed to implement the rectifier.

13. The lap counter as claimed in claim 1, wherein the sliding window averaging circuit is operable with a window width of substantially three seconds.

14. The lap counter as claimed in claim 1, wherein the processor is programmed to implement the sliding window averaging circuit.

15. The lap counter as claimed in claim 1, wherein the processor is programmed to distinguish the change in the output signal of the compass sensor to detect a rise above a predetermined upper threshold and a subsequent fall below a predetermined lower threshold, or vice versa, to identify a wave in the output signal representing a swimming stroke of the swimmer and to count the swimming strokes.

16. A lap counter for use by a swimmer, comprising:

a case;

attachment means for attaching the case to a swimmer;

a compass sensor housed in the case providing an output signal which changes between opposite directions along which the swimmer swims back and forth;

an operating circuit including a processor programmed to distinguish changes in the output signal of the compass sensor between the opposite directions to identify a reversal in direction of swimming by the swimmer and to count laps, each lap being based on two successive reversals in direction; and input means on the case for input of body weight of the swimmer, wherein the operating circuit is programmed to identify changes in the output signal of the compass sensor between successive strokes of the swimmer for determining stroke frequency, and to calculate calorie consumption by the swimmer according to number of laps, the stroke frequency, the body weight of the swimmer, and duration of swimming.

17. The lap counter as claimed in claim 16, wherein the processor is programmed to distinguish the change in the output signal of the compass sensor to detect a rise above a predetermined upper threshold and a subsequent fall below a predetermined lower threshold, or vice versa, to identify a wave in the output signal representing a swimming stroke of the swimmer and to count the swimming strokes.

18. A stroke counter for use by a swimmer, comprising:

a case;

attachment means for attaching the case to a swimmer;

a compass sensor housed in the case for providing an output signal which changes as the swimmer swims; and an operating circuit including a processor programmed to distinguish changes in the output signal of the compass sensor to detect a rise above a predetermined upper threshold and a subsequent fall below a predetermined lower threshold, or vice versa, to identify a wave in the output signal representing a swimming stroke of the swimmer and to count the strokes.

19. The stroke counter as claimed in claim 18, wherein the processor includes means for determining time between a presently detected wave in the output signal and a last identified wave and for comparing the time with a predetermined value for validating the wave identified.

20. The stroke counter as claimed in claim 19, wherein the predetermined value comprises a range within which the time should fall for the wave identified to be validated.

* * * * *